United States Patent [19]

Strojny

[11] 4,241,624

[45] Dec. 30, 1980

[54] EDGE SHARPENER

[75] Inventor: Werner Strojny, Marienheide, Fed. Rep. of Germany

[73] Assignee: Firma August Rüggeberg, Marienheide, Fed. Rep. of Germany

[21] Appl. No.: 945,132

[22] Filed: Sep. 25, 1978

[30] Foreign Application Priority Data

Oct. 4, 1977 [DE] Fed. Rep. of Germany ..... 2744521

[51] Int. Cl.[3] ..... B21K 17/00; B23D 71/06

[52] U.S. Cl. ..... 76/83; 76/88; 29/80; 280/809

[58] Field of Search ..... 76/82, 83, 88; 51/205 WG, 214, 228, 391, 392, 393; 280/11.37 T; 30/169; 29/80

[56] References Cited

U.S. PATENT DOCUMENTS

| | | | |
|---|---|---|---|
| 1,412,888 | 4/1922 | Novak | 30/169 |
| 1,538,710 | 5/1925 | Lucas | 29/80 |
| 2,871,729 | 2/1959 | Schoonover | 76/82 |
| 3,621,571 | 11/1971 | Gern | 30/169 |
| 3,670,601 | 6/1972 | Weeks | 76/83 |
| 3,831,235 | 8/1974 | Weninger | 76/82 |
| 3,934,287 | 1/1976 | Howard | 51/205 WG |
| 3,991,429 | 11/1976 | Honaver | 29/80 |

FOREIGN PATENT DOCUMENTS

| | | | |
|---|---|---|---|
| 206236 | 1/1908 | Fed. Rep. of Germany | 51/205 WG |
| 600916 | 8/1976 | Switzerland | 280/11.37 T |

*Primary Examiner*—Harold D. Whitehead
*Assistant Examiner*—K. Bradford Adolphson

[57] ABSTRACT

An edge sharpener, in particular for sharpening the steel edges of skis, is composed of a main body in which there is a recess for holding a file blade and within which is inserted a clamping wedge so as to exert distributed forces on the surface area of the file blade when the clamping wedge is forced into the recess substantially radially. In a particular feature of the invention, the main holder has a flexible foil which comes to lie between the pressure surface of the clamping wedge and the surface of the file so that movement of the clamping wedge does not result in abrasive contact with the surface of the file. The lower part of the clamping wedge has an inclined surface which cooperates with a similarly inclined surface in the holder. The clamping wedge is further equipped with gripping surfaces so that, during manual use, the force of the hand on the sharpener to execute the sharpening strokes tends to move the clamping wedge more forcefully into the recess, thereby increasing the clamping action.

13 Claims, 12 Drawing Figures

EDGE SHARPENER

FIELD OF THE INVENTION

The invention relates to a device for sharpening edges of objects, and in particular to sharpen edges of skis. More particularly, the invention relates to a device for holding a file in such a way that part of its surface is exposed and the holder can be guided along the edge of the ski to cause the file to sharpen the edge.

BACKGROUND OF THE INVENTION

Ski sharpeners in which file blades are held in a variety of ways are known in the art. In one of the known file holders, for example that described in the German Offenlegungsschrift No. 23 46 717, (Mar. 27, 1975, Kollmeder), the file holder has a slot which receives the file blade and is provided with a thumb screw which penetrates the wall of the holder and enters the slot, thereby holding the file blade by pressure. The thumb screw is knurled, permitting manual release, but it is unable to hold the file without chattering and causes damage to the file blade due to the extremely high local pressures exerted by the tip of the screw onto the teeth of the file, causing breakage of the file teeth. The inability of a single screw to hold the file blade securely in place causes it to be incapable of clean sharpening of the edge of an object, in particular the edge of skis. Moreover, the above-described device is intended to be used only within a shop environment so that tools for loosening the screw would normally be available, thereby making the possibility of manual release relatively superfluous.

Another device for filing the guide edges of skis is known from the German Gebrauchsmuster No. 69 19 027, (June 6, 1969, Ammerhofe), which describes a file holder in which a file is clamped between a main guide body and a clamping dog made of wood or the like. The clamping dog is attached to the guide body with screws. The main body of the holder has guide surfaces for receiving the base or the side surfaces of the ski. In this known device, the file may be released only by means of workshop tools.

Another known ski sharpening device is known from the German Gebrauchsmuster No. 76 06 126, (Aug. 5, 1976, C. O. Oberg and Company), which describes a file holder with a recess, the ends of which include support ribs while the file blade is held in place by a central screw. The application of force by the central screw causes an axial bending of the file which produces an effective cutting surface, especially for hard materials. The clamping and release of the file and the holder is possible only by means of shop tools. The point support of the file blade causes breakage of the file teeth.

Finally there is known from U.S. Pat. No. 3,670,601, (Jan. 27, 1976, Howard), a file holder for sharpening skis in which a file blade is held in a holder by being clamped at its ends with the aid of two covers which are urged toward one another by a traversing rod equipped with a thumb screw. This manner of mounting the file blade does not insure secure and rattle-free attachment.

Still further known are devices for filing the edges of skis, etc. in which a holder is provided with a simple slot into which a file blade is inserted. These devices all are unable to secure chatter-free holding of the file blade.

SUMMARY OF THE INVENTION

It is a principal object of the invention to provide an edge sharpener of the general type described above which overcomes the aforementioned disadvantages and which provides a rigid, chatter-free yet easily releasable mounting of the file blade within its holder.

This object is attained according to the invention by providing a holder with an at least partially releasable clamping wedge having at least one inclined surface which cooperates with a similarly inclined surface in the main body of the file holder. It is a further feature of the invention that the file holder is provided with at least one locally fixed and elastically deformable foil which is placed between the clamping wedge and the file when the file is being inserted in the holder. The wedge clamping provides the advantage of being easily releasable and simple to manufacture. Furthermore, the file blade is held at its entire surface and not merely at a single point, which is a necessary requirement for rigid and chatter-free securing of the file blade.

The presence of the elastic foil between the clamping wedge and the associated cutting surface of the file prevents direct friction between the file teeth and the clamping wedge which would cause wear and tear. Any displacements of the clamping wedge for the purpose of allowing the insertion or the release can at most result in contact between the pressure surfaces of the clamping wedge and a surface of the foil or foils whereas no motion takes place between adjacent foils or between the foils and the adjacent side of the file, thereby eliminating the wear and tear which would take place if the clamping wedge were moved directly and under relatively high pressure against the surface of the filing blade. Accordingly, the invention permits the use of files having teeth on both sides. The clamping wedge and the foil have smooth surfaces facing one another which can be relatively easily displaced after release of the wedge. A further advantage of the apparatus according to the invention is the possibility of complete utilization of the filing blade so that every part of its surface can be employed for filing the edge of the object.

A further advantageous feature of the invention is that the clamping wedge is so attached to the main holder as to be displaceable therein so as to permit the insertion of the file blade and its subsequent clamping but to remain captive in the holder so as to prevent complete removal therefrom.

A further advantageous feature of the invention is that the external surface of the clamping wedge is made substantially concave in such a manner that, when the file holder is used, the pressure exerted by the hand of the user tends to urge the clamping wedge in the direction which increases the holding pressure on the file blade. This construction and disposition provides especially secure and positive holding of the file blade. A particularly secure hand-hold is obtained if gripping surfaces are provided on ribs integral with the clamping wedge and if the separation of the ribs is such as to correspond to approximately the average thickness of a human finger. Due to this construction, the fingers of the user partially enter the space between the ribs and press against the gripping surface of the ribs so that the file holder does not tend to slip out of the hand of the user.

A still further advantageous construction of the file holder according to the invention is that the portion of the clamping wedge which extends from the main body of the holder is provided with tips which extend from the holder and which serve to release the clamping wedge from the holder in a relatively easy manner by exerting pressure on the free ends of the tips. At the same time, the ends of the tips are shaped in such a way as to make the clamping wedge captive with respect to the main holder by enlarging the ends of the tips and causing them to engage elastically deformable crossbars which join adjacent parts of the holder. Accordingly, the clamping wedge may be pulled out of the main body of the holder until the enlarged tips engage the crossbars.

A still further advantage is that the ribs of the holder are connected by an axial guide bar which extends beyond the surface holding the file blade by an amount substantially equivalent to the thickness of the foil and the file blade. This guide bar tends to cover the narrow edge of the file and protect the user against contact therewith. When the file blade is clamped in place in the holder, only a narrow strip of its large surface is exposed for the purpose of filing the guide edges of skis, etc.

Further advantages and characteristics of the invention will emerge from the detailed description of an exemplary embodiment taken in conjunction with the drawing.

DETAILED DESCRIPTION OF THE INVENTION

Figure 1:
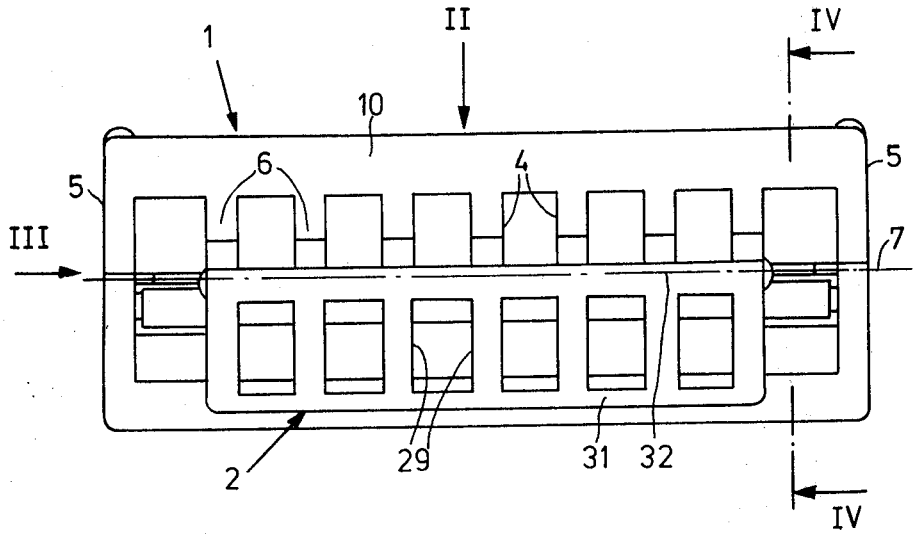
FIG. 1 is a top view onto the device according to the invention showing the clamping wedge pulled out of the holder as far as possible.

The edge sharpener according to the invention substantially includes a main holder body 1, a clamping wedge 2 and, held therebetween, a file blade 3. The relative disposition of these elements is seen most clearly from the sectional view of FIG. 4. It will be further evident, from FIGS. 3 and 4 especially, that the cross-sectional shape of the sharpener according to the invention is that of an incomplete circle and that the overall shape of the device is that of an incomplete circular cylinder. The holder is constructed from a stack of mutually similar and parallel plates 4 separated from one another by an equal distance and the ends of the stack are constituted by two identical end plates 5. Each of the discs 4 and the end plates 5 are provided with guide surfaces 6 extending in the manner of a secant, all of which lie in a plane that is parallel to the longitudinal axis 7 of the holder 1. The mutually parallel discs 4 and end plates 5 are attached to one another by crossbars 8, 9 which are also parallel to the long axis 7 of the holder. The crossbars 8 are disposed below the guide surfaces 6 and are so located that the surfaces thereof together with the guide surfaces 6 define a common guide surface 10. (See especially FIG. 4) The crossbars 9 are disposed substantially diametrically opposite the crossbars 8. The discs 4 are still further connected by plate-like bridges 11, also parallel to the longitudinal axis 7 and further parallel to the guide surface 10 but located in the region of the circumference of the discs remote from the guide surface 10.

Each of the discs 4 has a recess 13 which is perpendicular to the guide surface 10 and lies in the central plane 12 of the holder and all of the recesses 13 are identically disposed so as to constitute an overall axial recess. The recesses 13 are limited at the side facing the guide surface 10 by a contact surface 14 which is exactly at right angles to the guide surface 10 and the guide surfaces 6 so that a file blade 3 which is pressed against the contact surfaces 14 would be exactly perpendicular to the guide surfaces 6, 10. However, the contact surfaces 14 are so constructed as to be slightly concave with respect to the central plane 12 in their axial extent in order that, when the file blade 3 is clamped against the contact surface 14, it will be caused to exhibit a very slight amount of axial convex curvature on the side being used for filing. The recesses 13 are further defined by a bottom surface 15 against which a narrow edge surface 16 of the file blade comes to rest (see FIGS. 6 and 12). Between the guide surfaces 6 and the contact surfaces 14, each of the plates 4 is provided with an oblique beveled surface 17 which facilitates the insertion and removal of a file blade into and from the recesses 13.

Figure 6:
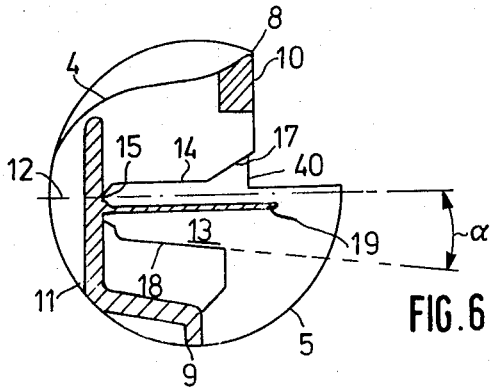
FIG. 6 is a section through the illustration of FIG. 5 along the line VI—VI.
Figure 7:
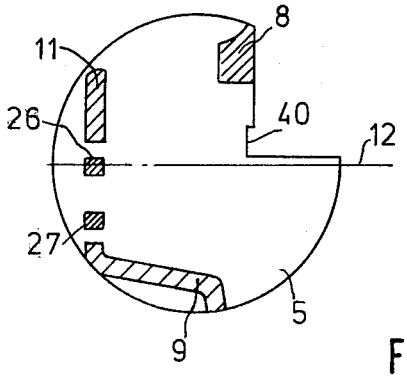
FIG. 7 is a section of the illustration of FIG. 5 along the line VII—VII.

The opposite side of the recesses 13 is defined by clamping surfaces 18 which are disposed obliquely and by an angle $\alpha$ of approximately 8° with respect to the central plane 12 in a manner best seen in FIG. 6. Extending from the plate-like bridges 11 are foils 19 of substantially rectangular shape which extend freely into the recess 13 and are capable of considerable elastic deformation, i.e., bending. However, these foils are of substantial thickness, for example approximately 1 mm thick. The distance between the contact surfaces 14 and the foils 19 is made substantially equal to the thickness d of a file blade 3 (see FIG. 4).

Figure 2:
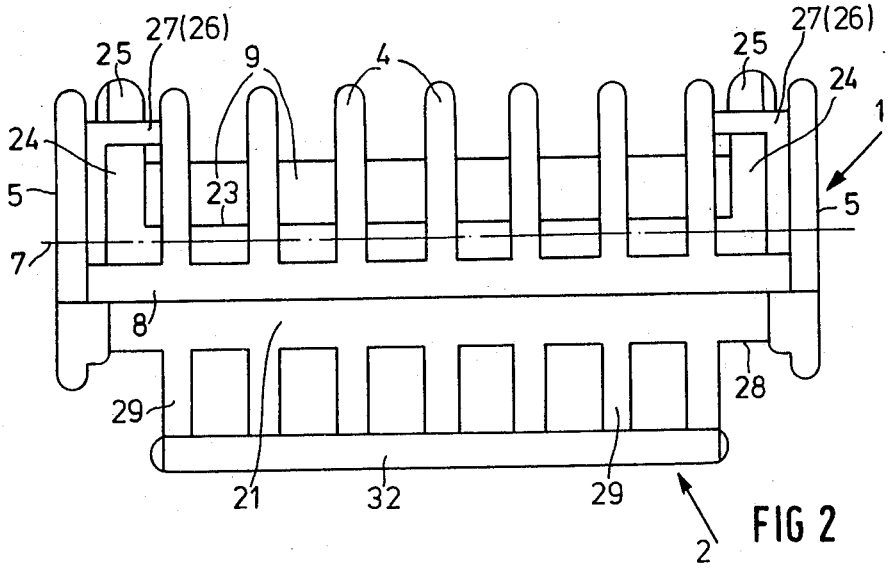
FIG. 2 is a view of the device in FIG. 1 in the direction of the arrow II.
Figure 3:
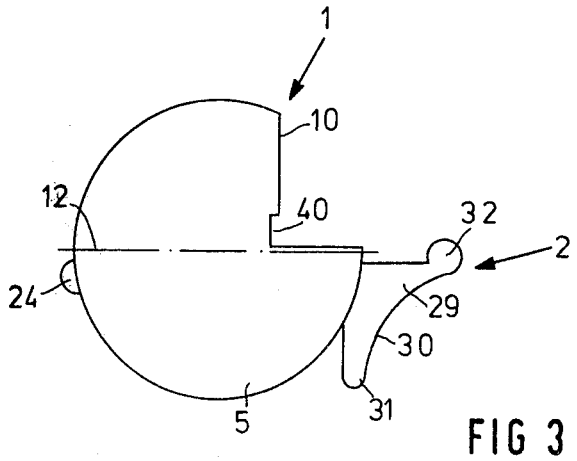
FIG. 3 is a side view of the device shown in FIG. 1 in the direction of the arrow III.
Figure 4:
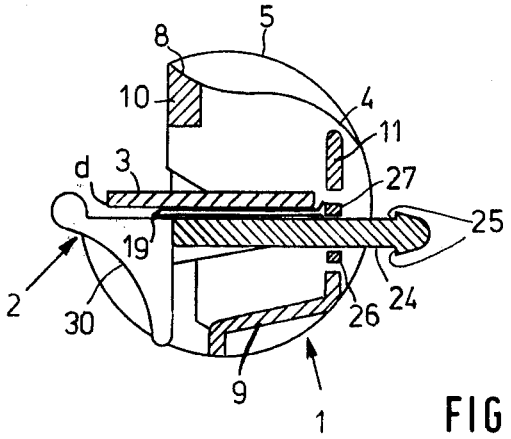
FIG. 4 is a section through the device of FIG. 1 along the sectional line IV—IV showing an inserted file blade and a fully inserted clamping wedge.
Figure 5:
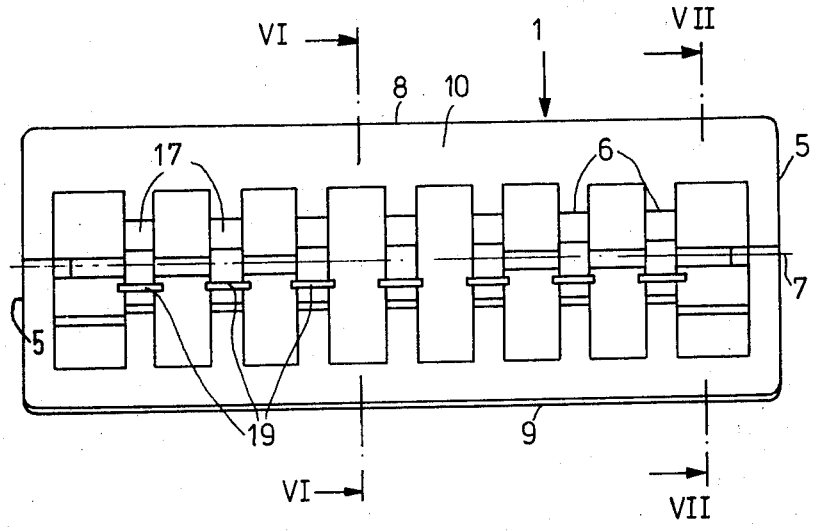
FIG. 5 is a top view on the file holder similar to the view of FIG. 1.
Figure 8:
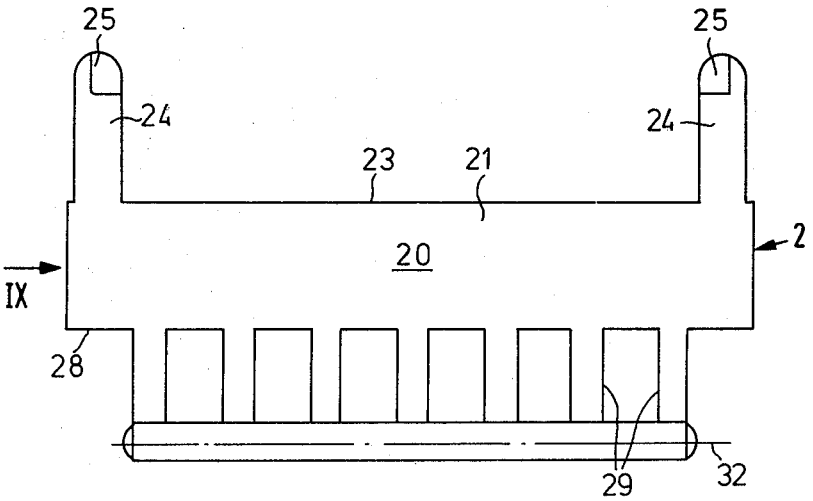
FIG. 8 is a top view of a removed clamping wedge.
Figure 9:
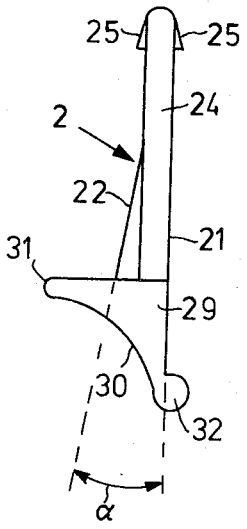
FIG. 9 is a side view of the clamping wedge of FIG. 8 along the arrow IX.
Figure 10:
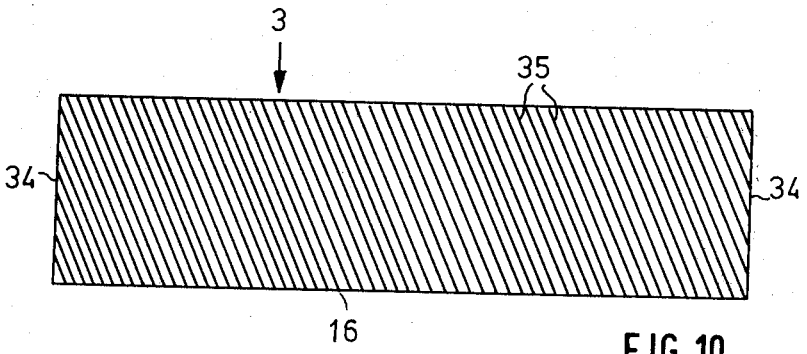
FIG. 10 is a top view of a flat file blade.

The clamping wedge, which constitutes the movable part of the file holder according to the invention, includes a rail 20 (best seen in FIG. 8) whose length is equal to the distance between the end plates 5. The clamping wedge has a pressure surface 21 which is disposed to press against the foils 19 and, on the other side, is provided with wedge surfaces 22 which, in the clamping position, engage the inclined clamping surfaces 18 and are also disposed at the wedge angle $\alpha$ with respect to the pressure surface 21. In a direction parallel to the longitudinal side 23 of the wedge, the pressure surface 21 is convex so as to permit the clamped file blade to acquire a small degree of convex curvature of, for example, a few tenths of a millimeter on the exposed side, thereby insuring a fully chatter-free filing of the metal edge of the skis. Extending from the ends of the side 23 of the clamping wedge are tips 24 provided with terminal hooks 25. The tips 24 extend into the free space defined between the end plates 5 and the adjacent discs 4. Each end plate 5 and its adjacent disc 4 is further joined by two parallel bars 26 and 27 (see FIGS. 2 and 11) which are separated from one another by a distance somewhat greater than the thickness of the tips 24 but somewhat smaller than the radial extent of the hooks 25. Inasmuch as the crossbars 26, 27 are narrow and therefore elastically deformable, the hooks 25 on the tips 24 may be pushed between these bridges while the bridges are being bent apart. However, any subsequent motion of the clamping wedge out of the holder is limited by the engagement of the hooks 25 with the crossbars 26, 27. The somewhat longer opposite edge 28 of the clamping bar is provided with ribs 29 whose width is substantially equal to the thickness of the discs 4 and which are disposed at the same relative distance from one another as are the discs 4. These ribs 29 are mutually parallel and axially congruent and each of them exhibits a concave gripping surface 30 as best illustrated in FIGS. 3 and 4. At their ends, they are joined (see FIG. 8) by a longitudinal rail 32. The top surface of the ribs 29 is flush with the pressure surface 21 of the bar 20. The rail 32 extends out of the plane of the pressure surface 21 by an amount substantially equal to the sum of the thickness of the foil 19 and the thickness d of the file blade 3.

The procedure to insert a file blade 3 into the holder is as follows: As a first step, the clamping wedge 2 is pulled out of the recesses 13 until the hooks 25 engage the crossbars 26, 27 as illustrated in FIGS. 2 and 3. Subsequently, a file blade 3 is inserted into the recesses 13 from the direction of the guide surfaces 6 and passing over the beveled surfaces 17 and in such a way that one of its large surfaces is placed against the contact surfaces 14 whereas the other large surface is placed against the adjacent surfaces of the foils 19. The file blade is pushed into the recesses 13 until one of its edges 16 makes contact with the surfaces 15. However, it is possible to insert the file blade only far enough that approximately one-fourth of its width is engaged by the contact surfaces 14. In this manner, a majority of the file surface may be effectively utilized in a single orientation, while remaining securely clamped. Longitudinal displacements of the file blade within the holder 1 are prevented by the inner surfaces of the end plates 5 which make contact with the ends 34 of the file blade. Subsequently, the clamping wedge 2 is reinserted into the holder 1 so that the pressure surface 21 of the bar 20 makes contact with the adjacent surface of the foils 19 while the wedge surfaces 22 contact the corresponding wedge surfaces 18 in the main body of the holder. When the clamping wedge is firmly pushed into the holder, the file blade 3 is held against the contact surfaces 14 with a correspondingly great force. The presence of the foils 19 between the pressure surface 21 of the clamping wedge 2 and the toothed surface 35 of the file blade prevents the wear and tear which would take place due to the relative motions of the file and the clamping wedge in the absence of these foils 19.

Figure 11:
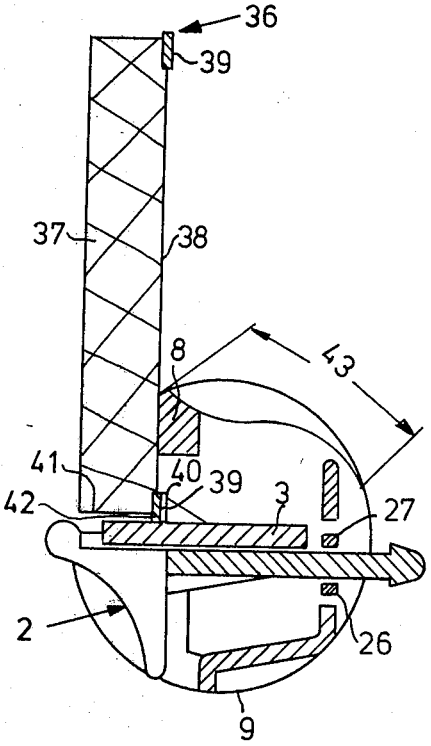
FIG. 11 is a representation similar to that of FIG. 4 in which the file holder is shown in use and in position to sharpen the lateral edge of the guide rail of a ski.

When the file holder according to the invention is used to sharpen the lateral guide rails 36 of skis 37, for example steel edges, the device is held against the ski 37 in such a way that the base 38 of the ski comes to lie against the guide surfaces 10 and 6 as illustrated in FIG. 11. The bottom surface 39 of the guide rail 36 extends somewhat into the part of the recess 13 adjacent to the beveled surfaces. In order to accommodate the protruding part of the ski edge 36, recesses 40 are cut into the end plates 5 so as to prevent contact of the bottom surface 39 of the steel edges 36 with the file holder. The narrow edge 42 of the steel edge which extends somewhat beyond the side surface 41 of the ski, makes contact with the teeth 35 of the clamped file blade 3 and can thus be filed and sharpened by appropriate lengthwise motions of the device along the ski.

Figure 12:
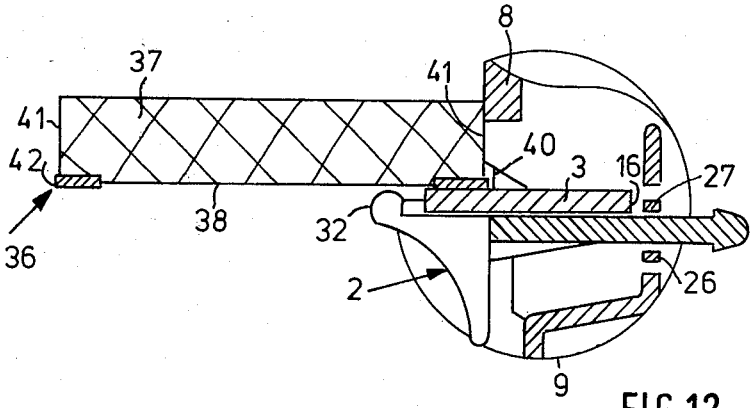
FIG. 12 is an illustration similar to that in FIG. 11 in which the file holder according to the invention is used to sharpen the bottom surface of the guide edge of a ski.

If the bottom surface 39 of the steel edge is to be sharpened, then the device is so attached to the ski that the guide surfaces 6 and 10 come into contact with the side 41 of the ski, as illustrated in FIG. 12. The part of this steel edge 36 which extends beyond the side surface 41 again extends into the recesses 40 in the end plates 5 or the recesses 13 in the discs 4. The bottom 39 of the steel edges 36 makes planar contact with the toothed surface 35 of the file blade 3. The running surface of the ski 37 tends to make contact with the edge 32 before an inadvertent tilting of the device can cause the file blade to damage the unprotected running surface. When used in the foregoing manner, the device is held in such a way that the fingertips of the hand which holds the device come to lie on the concave gripping surfaces 30 of the ribs 29. The adjacent cylindrical region of the discs 4 is enveloped by the hand of the user and all of the hand and the thumb naturally come to lie in the convex-concave curved region 43 of the discs 4 (see FIG. 11) which extends from the guide surface 10 in the direction of the tips 24. As may be seen from FIGS. 4, 11 and 12, the tang part of the clamping wedge lies substantially in the circular sector which is defined by the adjacent discs 4. This construction makes it possible for the entire sharpener to lie comfortably within the hand. It is a further distinctive feature of the invention that, when the device is firmly gripped during the filing operation, the clamping wedge 2 is urged more forcefully into the main body 1, thereby further enhancing the holding action of the wedge against the file blade 3 and thus securing the file blade 3 especially firmly at a time when it is being actually used for sharpening.

In order to provide the comfortable grip which the hand of the user has on the device, the discs 4 extend over a region substantially equal to or somewhat greater than the average width of a hand. The average separation of adjacent discs 4 or adjacent ribs 29 is intended to be substantially equal to the average thickness of a finger, thereby insuring a firm, slip-free grip on the device.

Suitably, the main holding body 1 including the crossbar 11 and the integral foils 19 as well as the clamping wedge 2 may be made of a hard elastic and moldable synthetic plastic. A suitable synthetic material is, for example, an acetal copolymer, for example the product marketed under the Trademark "Hostaform" by the firm Hoechst-AG, Frankfurt, West Germany. The construction of the main body 1 and the gripping surfaces 3 on the clamping wedge 2 permit the use of the sharpening device by left-handed as well as by right-handed persons. Preferably and normally, the user would employ the device by executing a pulling motion over the object in the direction of his own body.

As may be seen from FIGS. 4, 11 and 12, the tips 24 extend relatively far out of the holder when the clamping wedge is fully inserted. In order to release the clamping wedge, it is necessary only to apply pressure to the free tips 24. When the clamping wedge 2 has been fully pulled out of the holder, the tips 24 extend only very slightly from the main body 1 as can be seen from FIG. 3.

While the application of the sharpening device according to the invention has been illustrated and discussed principally with respect to sharpening the steel edges or rails of skis, the sharpening device may be used without alteration for deburring the edges of metal plates or the like. Furthermore, the foregoing description relates only to a preferred embodiment of the invention and it is understood that other embodiments and variants are possible without departing from the spirit and scope of the invention.

I claim:

1. An edge sharpener comprising:

a file blade;

a main body provided with an external guide surface for aligning said body with the surface of an object to be sharpened, and further provided with an internal recess for receiving therein said file blade, said internal recess being defined by at least one contact surface for making area contact with one side of said file blade, a second surface which is inclined with respect to said contact surface and a bottom surface of said main body; and a rigid clamping wedge, configured to enter said recess via an opening in said main body at least partially for clamping said file blade therein, said clamping wedge having a pressure surface for pressing said file blade toward said contact surface of said main body and further having an inclined wedge surface for pressing against said second surface of said main body which is inclined with respect to said contact surface; and wherein there is further provided in said main body a flexible foil locally fixed to said main body within said internal recess along said bottom surface of said main body opposite said opening and being flexible toward said pressure surface of said clamping wedge, said foil being so disposed as to come to lie between the surface of said file blade remote from said contact surface and the pressure surface of said clamping wedge.

2. An edge sharpener according to claim 1, wherein said main body in said clamping wedge includes means for permitting limited relative displacement and for holding said main body and said clamping wedge mutually captive.

3. An edge sharpener according to claim 1, wherein a long surface of said clamping wedge is located externally of said recess in operative association with said main body, and wherein said clamping wedge is provided with at least one concave gripping surface, the geometric normal of which is directed substantially in the direction in which said clamping wedge enters said recess.

4. An edge sharpener according to claim 3, wherein said at least one gripping surface consists of a plurality of gripping surfaces and said clamping wedge has integral parallel ribs on which said gripping surfaces are provided.

5. An edge sharpener according to claim 3, wherein a side of said clamping wedge remote from said at least one gripping surface is provided with at least one elongated tip which protrudes from said main body when said clamping wedge is inserted in said recess.

6. An edge sharpener according to claim 5, wherein said main body is provided with elastically deformable bars between which enter said at least one tip and wherein ends of said tips are provided with hooks which engage said bars at the limit of release of said clamping wedge from said main body.

7. An edge sharpener according to claim 4, wherein the ribs of said clamping wedge are joined on a side adjacent to said pressure surface by a guide rail which extends beyond a plane defined by said pressure surface by an amount equal to the sum of the thickness of said file blade and the thickness of said flexible foil

8. An edge sharpener according to claim 1, wherein said main body is constructed from a plurality of mutually parallel but separated discs which are held in rigid mutual alignment by axial crossbars.

9. An edge sharpener according to claims 1 or 8, wherein face ends of said main body are end plates having internal surfaces which make contact with ends of said file blade.

10. An edge sharpener according to claim 8, wherein portions of said axial crossbars define said external guide surface.

11. An edge sharpener according to claim 9, wherein each of the discs disposed between said end plates has a circumferential region in the vicinity of said guide surface which is alternately concave and convex with respect to a circular circumference.

12. An edge sharpener according to claim 1, wherein each of said main body and said clamping wedge is made of a hard synthetic plastic material.

13. An edge sharpener according to claim 8, wherein said flexible foil comprises a plurality of separate flexible foil members provided on said main body to extend into said recess in the vicinity of each of said discs.

* * * * *